United States Patent [19]

Jokel

[11] Patent Number: 4,837,974

[45] Date of Patent: Jun. 13, 1989

[54] WINDOW INSTRUSION BARRIER

[76] Inventor: Isidore Jokel, 4201 Newport "H", Deerfield Beach, Fla. 33441

[21] Appl. No.: 224,673

[22] Filed: Jul. 27, 1988

Related U.S. Application Data

[63] Continuation-in-part of Ser. No. 948,204, Dec. 31, 1986, abandoned, Continuation-in-part of Ser. No. 854,428, Apr. 21, 1986, Pat. No. 4,680,890.

[51] Int. Cl.[4] ..... E06B 3/68

[52] U.S. Cl. ..... 49/55

[58] Field of Search ..... 49/55, 57, 61, 124

[56] References Cited

U.S. PATENT DOCUMENTS

| | | | |
|---|---|---|---|
| 2,662,242 | 12/1953 | McDhess | 49/57 X |
| 4,394,805 | 7/1983 | Napper | 49/55 |
| 4,400,911 | 8/1983 | Bell et al. | 49/55 |
| 4,532,734 | 8/1985 | Jokel | 49/55 |
| 4,573,285 | 3/1986 | Jokel | 49/55 |
| 4,575,965 | 3/1986 | Iversen | 49/57 X |
| 4,646,491 | 3/1987 | Munch | 49/55 X |
| 4,680,890 | 7/1987 | Jokel | 49/55 |

*Primary Examiner*—Philip C. Kannan
*Attorney, Agent, or Firm*—M. K. Silverman

[57] ABSTRACT

A barrier apparatus for the safeguard of an open window, exhibiting first and second grid work panels horizontally spaced in slideable juxtaposition, the panels having rigid rectangular frames adapted to border and support the window, each frame comprising horizontally disposed upper and lower rods, an inner and outer vertically oriented border, the inner borders facing each other, such facing (inner borders) having vertically spaced guide holes, the inner and outer vertically oriented borders further having ornamental elements respectively secured at an offset horizontally transverse to the axis of the rods, which offset is approximately equal in extent to an outer transverse edge of a window casement, the plate metal means proportioned to respectively cover each of the first and second grid work panels, in which the sheet metal means will move with its respective panel as one panel is moved relative to the other. The panels defining a subsystem having an adjustable length adapted for insertion into the window casement, and slideably positionable and repositionable within said casement. Also included are first and second horizontally directed post respectively affixed medially between respectively upper and lower pairs of horizontal rods of each panel, said posts affixed to said borders and adapted to slidably penetrate said guide holes. Also provided are locking means for securing one of said posts of one of the panels to an inner border of an opposite with effectively defining the position of the first panel relative to the second panel.

7 Claims, 3 Drawing Sheets

WINDOW INSTRUSION BARRIER

REFERENCE TO THE INVENTION

This case is a continuation-in-part of Application Ser. No. 948,204, filed Dec. 31, 1986, abandoned, which is a continuation-in-part of Application Ser. No. 854,428, filed Apr. 21, 1986, entitled Window Intrusion barrier, now U.S. Pat. No. 4,680,890.

BACKGROUND OF THE INVENTION

This invention concerns an apparatus for the prevention of unauthorized entry by a person into a building and, more particularly, concerns a barrier apparatus of adjustable dimension which may be removably inserted into the framework of an open window of a building to prevent passage therethrough.

In residential and industrial buildings, windows capable of opening and closing, and having transparent panels, serve to permit entrance of sunlight and passage of air, and function as emergency exits in case of fire. However, when such windows are open, the security of the building is threatened because of the relative ease with which an intruder may enter through the open window.

Various devices have been disclosed for thwarting unaurthorized entrance through an open window while still retaining most of the functionally of the window. Such devices, however, have not heretofore been entirely successful. For complete effectiveness, the barrier device should be capable of easy installation into, and rapid removal from, variously sized window casements while being non-removable by a would-be intruder. The barrier should furthermore provide minimal occlusion of the area it occupies while having sufficient strength to resist forceful breakage.

The pertinent prior art, as best known to the inventor, is reflected in unpatented products known as (1) WIND-O-GUARD, produced by the Leslie Lock company of Atlanta, Ga. 30339 and (2) BURGLAR BARS, produced by Sterling Hardware Corp. of Richmond, Ill. 60071. The instant invention also represents an improvement over my U.S. Pat. Nos. 4,532,732 and 4,573,285, and, as well, over my U.S. Pat. No. 4,680,890.

Other related prior art which, however, does not make use of the invention's transversely horizontally offset ornamental plate means are U.S. Pat. Nos. 4,394,805; 4,400,911; and 4,532,734.

SUMMARY OF THE INVENTION

The invention comprises a barrier apparatus for a vertically adjustable window having first and second gridwork panels horizontally spaced in slidable juxtaposition, said panels comprising rigid rectangular frames adapted to border and support said window, each frame comprising horizontally disposed upper and lower rods, each frame having inner and outer vertically spaced guide holes, and inner and outer vertically oriented borders comprising plate metal means respectively secured thereto at an offset horizontally transverse to the axes of said rods, which offset is approximately equal in extent to an outer transverse edge of a casement of said window, said plate metal means proportioned to respectively cover each of said first and second gridwork panels, in which said sheet metal means will thereby move with its respective panel as one panel is moved relative to the other of said panels, defining a subsystem having an adjustable length adapted for insertion into the window casement, and slidably positionable and re-positionable within said casement; first and second horizontally directed posts respectively affixed medially between respectively upper and lower pairs of horizontal rods of each panel, said posts affixed to said borders and adapted to slidably penetrate said guide holes; and locking means for securing one of said posts of said panels to an inner border of an opposite of panels to prevent relative movement therebetween, thereby effectively defining the position of said first panel relative to said panel.

It is an object of the present invention to provide an ornamented barrier apparatus of an adjustable horizontal type capable of facile insertion into the rectangular space of the window casement of an open vertically slideable window.

It is another object of provide a barrier apparatus having the above advantages, that can be readily removed by a user but not readily removed by a would-be intruder.

It is further object to provide a barrier apparatus of the above nature having durable construction which, nonetheless, may be economically manufactured.

The above and yet other advantages of the present invention will become apparent from the hereinafter set forth Detailed Description of the Invention, the Drawings, and the Claims appended herewith.

DETAIL DESCRIPTION OF THE INVENTION

Figure 1:
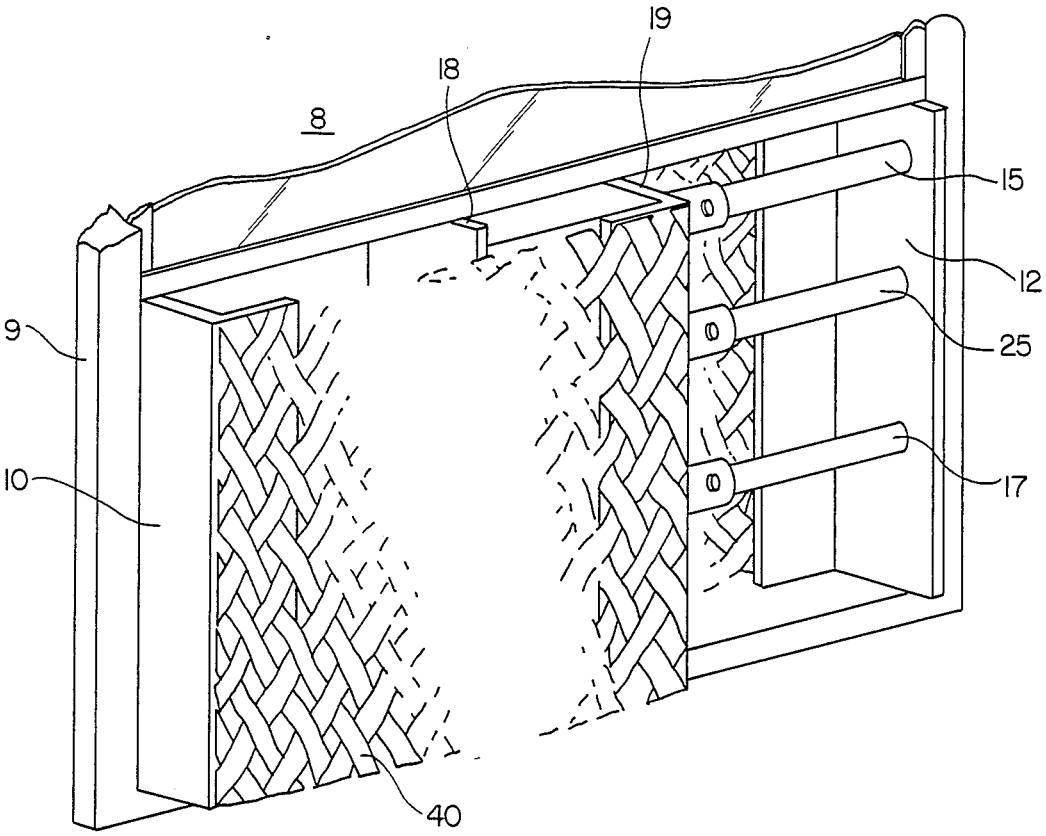
FIG. 1 is a perspective view of the inventive barrier apparatus installed in a window jamb.
Figure 2:
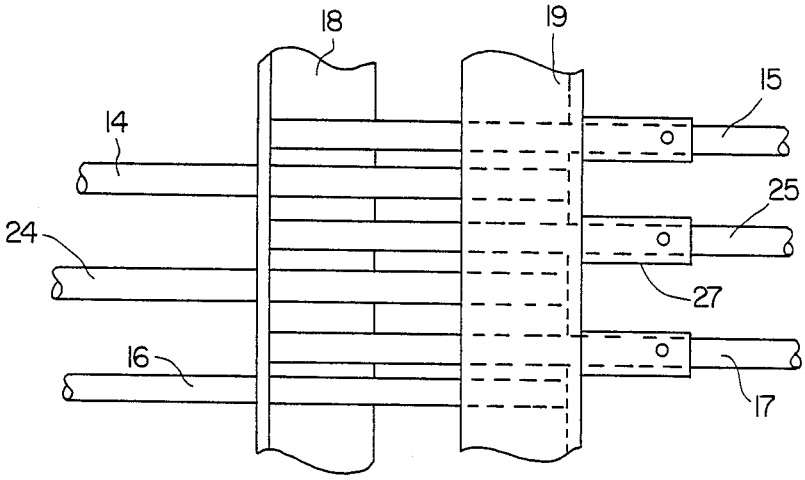
FIG. 2 is a front fragmentary plan, schematic view showing the respective gridwork panels mated with each other.

With reference to FIGS. 1 and 2, there is shown a vertically adjustable window 8 having a window casement 9. The inventive apparatus includes a first gridwork panel 10 and a second gridwork panel 12. Said panels 10 and 12 are horizontally spaced substantially in co-planer juxtaposition relative to each other. Further, said panels 10 and 12 comprise rigid frames which border and support said panels. These frames, more particularly, comprise horizontally disposed upper rods 14 and 15, and lower rods 16 and 17. The vertical aspect of each frame comprises inner borders 18 and 19, and outer borders 20 and 21. It may be noted that inner border 18 of right gridwork panel 12 is oriented to face opposite to inner border 19 of gridwork panel 10.

Figure 4:
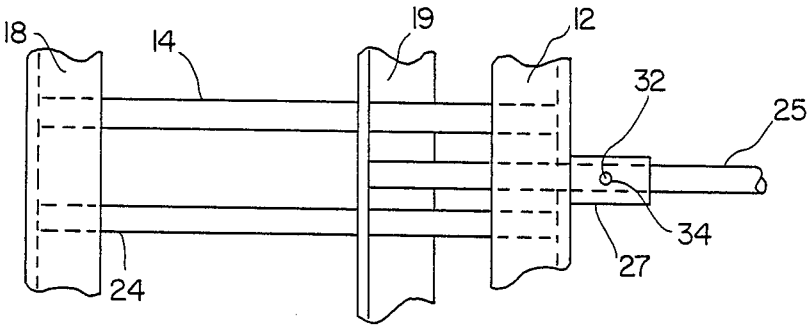
FIG. 4 is a front plan fragmentary view showing two male-female horizontal interfaces.
Figure 5:
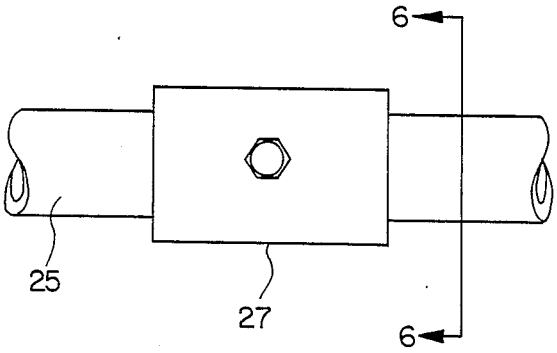
FIG. 5 is an enlarged view of the locking horizontal post area.

There is further provided horizontal posts 24 and 25 which ar disposed, respectively, between horizontal borders 14 and 16 as to panel 10, and borders 15 and 17 as to panel 12. It is noted that each group of horizontal elements is parallel to the other. As may be more particularly seen in FIGS. 2 thru 4, each horizontal element 14, 16 and 24 of first panel 10 and horizontal elements 15, 17 and 25 of second panel 12, are comprised of a cylindrical structure having a given diameter. These structures slide through specific diametered holes in borders 18 and 19. These horizontal elements are locked in place by the alignment of outer collar 27 and setscrews 32 within the holes of the horizontal elements, See FIGS. 4 and 5.

Figure 6:
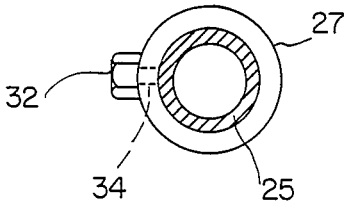
FIG. 6 is a radial cross-sectional view taken along Line 6—6 of FIG. 5.

In a preferred embodiment (FIGS. 4 to 6), a setscrew 32 is disposed within aperture 34. Through the selective advancement and, thereby, securement of said screw 32 against the surface of horizontal post 25, the respective position of post 25 relative to post 24 may be rigidly fixed. Thereby, the position of first gridwork panel 10 relative to second panel 12 is also defined.

Figure 3:
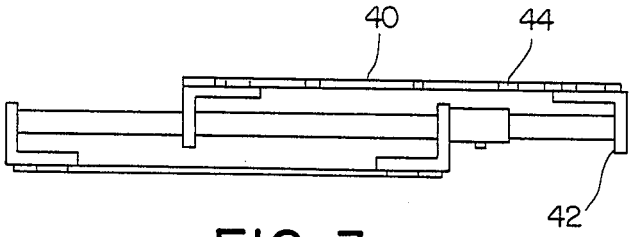
FIG. 3 is a top schematic view of FIG. 1, showing the sheet metal means included therewith.

With reference to FIGS. 1 and 3, there is shown sheet metal means 40, having a decorative character which, through the use of offset elements 42, is secured at a uniform distance from rods 14, 15, 16 and 17.

Also, said uniform distance created by the use of offset elements 42 is approximately equal in extent of an outer transverse edge of the casement 9 of window 8.

Each sheet metal means 40 is provided with decorative openings 44 to permit free flow of air through the structure and, as well, to impart an ornamental feature to the inventive window barrier apparatus. Many forms of sheet metal means, known in the trade as expanded metal, are available in materials such as aluminum, carbon steel, and stainless steel.

Figure 7:
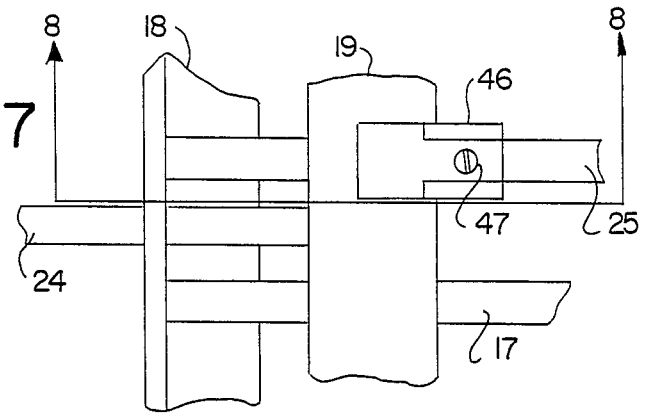
FIG. 7 is a fragmentary front plan, view similar to FIG. 2, however, showing a second embodiment of the locking means.
Figure 8:
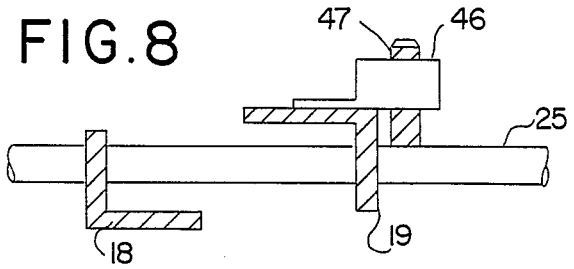
FIG. 8 is a sectional view taken along Line 8—8 of FIG. 7.

In FIGS. 7 and 8 are shown, in enlarged and sectional views, a second embodiment which may be employed to secure the horizontal elements of the respective first and second gridwork panels. These figures show the use of lug means 46 and ball 47 to achieve the same result discussed with respect to the setscrew 32 to FIGS. 5 and 6. The use of a lug means of the type shown in Fig. 7 is convenient to tighten and release, as may be desired.

Figure 9:
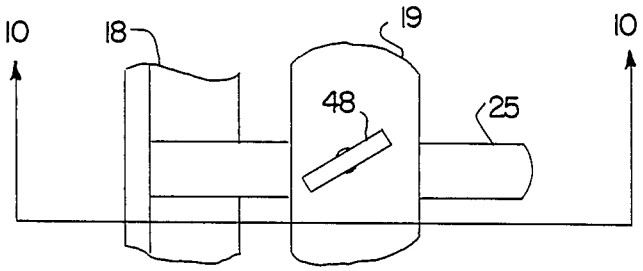
FIG. 9 is a fragmentary, front view showing a third embodiment of the locking means.
Figure 10:
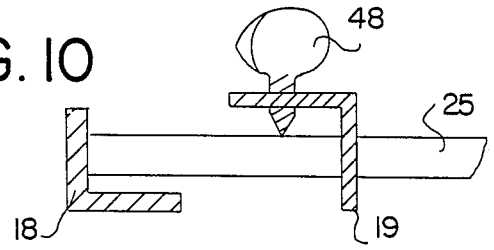
FIG. 10 is a sectional view taken along line 10—10 of FIG. 9.

In FIGS. 9 and 10 are shown a further embodiment of the lug means wherein a T-bolt 48 is sued in lieu of said lug means 46 of FIG. 9.

It is to be appreciated that the locking means 27 and means 46 or 48 should be disposed inside of sheet metal 40 so that it cannot be tampered with by a potential intruder. Using a structure of the above type, said first and second panels 10 and 12 may be easily secured or released from each other for suitable positioning within the window casement opening. A well, a pleasing decorative feature for the window apparatus is also achieved.

While there has been herein shown and described the preferred embodiment of the present invention, it is to be understood the invention may be embodied otherwise than is herein illustrated and described and that in said embodiments, certain changes in the detailed construction, and in the form and arrangement of parts may be made without departing from the underlying idea or principles of this invention within the scope of the appended claims.

I claim:

Having herein described my invention, what I claim as new, useful and nonobvious and, accordingly, secured by Letters patent of the United States is:

1. A barrier apparatus for a vertically adjustable window, comprising:

(a) a first and second gridwork panels horizontally spaced in slidable juxtaposition, said panels comprising rigid rectangular frames adapted to border and support said window, each frame comprising horizontally disposed upper and lower rods, each frame having an inner and outer vertically oriented border, and inner borders facing each other, said facing inner borders having vertically spaced guide holes, said inner and outer vertically oriented borders further comprising plate metal means respectively secured thereto at an offset horizontally transverse to the axes of said rods, which offset is approximately equal in extent to an outer transverse edge of a casement of said window, said plate metal means proportioned to respectively cover each of said first and second gridwork panels, in which said sheet metal means will thereby move with its respective panel as one panel is moved relative to the other of said panels, defining a subsystem having an adjustable length adapted for insertion into a window casement, and slidable positionable and repositionable within said casement;

(b) first and second horizontally directed posts respectively affixed medially between respectively upper and lower pairs of horizontal rods of each panel, said posts affixed to said borders and adapted to slidably penetrate said guide holes; and (c) locking means for securing one of said posts of one of said panels to an inner border of an opposite of said panels to prevent relative movement therebetween, thereby effectively defining the position of said first panel relative to said second panel.

2. The barrier apparatus as recited in claim 1 in which said sheet metal means comprises an ornamental pattern of apertures.

3. The barrier apparatus are recited in claim 1 in which said locking means comprises setscrew means.

4. The barrier apparatus as recited in claim 2 in which said locking means comprises setscrew means.

5. The barrier apparatus as recited in claim 4 in which said sheet metal means has therein an ornamental pattern of apertures.

6. The barrier apparatus as recited in claim 2 in which said locking means comprises lug means.

7. The barrier apparatus as recited in claim 2 in which said locking means comprises butterfly nut means.

* * * * *